US007128822B2

(12) United States Patent
Wang et al.

(10) Patent No.: US 7,128,822 B2
(45) Date of Patent: Oct. 31, 2006

(54) LEVELER COMPOUNDS

(75) Inventors: Deyan Wang, Hudson, MA (US); Chunyi Wu, Westford, MA (US); Robert D. Mikkola, Grafton, MA (US)

(73) Assignee: Shipley Company, L.L.C., Marlborough, MA (US)

( * ) Notice: Subject to any disclaimer, the term of this patent is extended or adjusted under 35 U.S.C. 154(b) by 576 days.

(21) Appl. No.: 10/453,423

(22) Filed: Jun. 4, 2003

(65) Prior Publication Data

US 2004/0249177 A1 Dec. 9, 2004

(51) Int. Cl.
*C25D 3/38* (2006.01)
*C23C 16/00* (2006.01)

(52) U.S. Cl. ..... 205/296; 205/297; 205/298; 106/1.26

(58) Field of Classification Search ..... 106/1.26; 205/296, 297, 298
See application file for complete search history.

(56) References Cited

U.S. PATENT DOCUMENTS

| | | | | |
|---|---|---|---|---|
| 3,328,273 | A | 6/1967 | Creutz et al. | 204/52 |
| 4,038,161 | A | 7/1977 | Eckles et al. | 204/52 R |
| 4,336,114 | A | 6/1982 | Mayer et al. | 204/52 R |
| 4,376,685 | A | 3/1983 | Watson | 204/52 R |
| 4,555,315 | A | 11/1985 | Barbieri et al. | 204/52 R |
| 5,232,575 | A | 8/1993 | Dodd | 205/238 |
| 5,607,570 | A | 3/1997 | Rohbani | 205/297 |
| 5,972,192 | A | 10/1999 | Dubin et al. | 205/101 |
| 6,024,857 | A | 2/2000 | Reid | 205/123 |
| 6,183,622 | B1 | 2/2001 | Janik | 205/585 |
| 6,361,823 | B1 | 3/2002 | Bokisa et al. | 427/98 |
| 6,425,996 | B1 | 7/2002 | Dahms et al. | 205/298 |
| 6,444,110 | B1 * | 9/2002 | Barstad et al. | 205/123 |
| 6,610,192 | B1 | 8/2003 | Step et al. | 205/297 |

FOREIGN PATENT DOCUMENTS

| | | | |
|---|---|---|---|
| DE | 1151159 | * | 4/1963 |
| DE | 196 43 091 A1 | | 4/1998 |
| EP | 1 069 211 A2 | | 1/2001 |
| GB | 1 526 076 | | 9/1978 |
| JP | 10-102278 | | 4/1998 |
| WO | WO 99/31300 | | 6/1999 |

* cited by examiner

*Primary Examiner*—Edna Wong
(74) *Attorney, Agent, or Firm*—S. Matthew Cairns

(57) ABSTRACT

Compounds that function to provide level or uniform metal deposits are provided. These compounds are particularly useful in providing level copper deposits. Copper plating baths and methods of copper plating using these compounds are also provided. These baths and methods are useful for providing a planarized layer of copper on a substrate having small apertures. The compositions and methods provide complete fill of small apertures with reduced void formation.

13 Claims, 4 Drawing Sheets

LEVELER COMPOUNDS

BACKGROUND OF THE INVENTION

The present invention relates generally to the field of electrolytic plating compositions. In particular, the present invention relates to the field of copper electroplating compositions.

Methods for electroplating articles with metal coatings generally involve passing a current between two electrodes in a plating solution where one of the electrodes is the article to be plated. A typical acid copper plating solution comprises dissolved copper (usually copper sulfate), an acid electrolyte such as sulfuric acid in an amount sufficient to impart conductivity to the bath, and proprietary additives to improve the uniformity of the plating and the quality of the metal deposit. Such additives include brighteners, levelers, surfactants, suppressors, and the like.

Electrolytic copper plating solutions are used for many industrial applications. For example, they are used in the automotive industry to deposit base layers for subsequently applied decorative and corrosion protective coatings. They are also used in the electronics industry, particularly for the fabrication of printed circuit boards and semiconductors. For circuit board fabrication, copper is electroplated over selected portions of the surface of a printed circuit board and onto the walls of through holes passing between the surfaces of the circuit board base material. The walls of a through hole are first metallized to provide conductivity between the board's circuit layers. For semiconductor fabrication, copper is electroplated over the surface of a wafer containing a variety of features such as vias, trenches or a combination thereof. The vias and trenches are metallized to provide conductivity between various layers of the semiconductor device.

It is well known in certain areas of plating, such as in electroplating of printed circuit boards, that the use of brighteners and/or levelers in the electroplating bath can be crucial in achieving a uniform metal deposit on a substrate surface. Plating a substrate having irregular topography can pose particular difficulties. During electroplating a voltage drop variation typically will exist along an irregular surface which can result in an uneven metal deposit. Plating irregularities are exacerbated where the voltage drop variation is relatively extreme, i.e., where the surface irregularity is substantial. As a result, a thicker metal deposit, termed overplating, is observed over such surface irregularities. Consequently, high quality metal plating (e.g., a metal layer or plate of substantially uniform thickness) is frequently a challenging step in the manufacture of electronic devices.

Leveling agents are often used in copper plating baths to provide substantially uniform, or level, copper layers. For example, U.S. Pat. No. 4,038,161 (Eckles et al.) discloses a method of producing level copper deposits by electroplating copper from a copper plating bath containing at least one organic leveling compound obtained by reacting one or more epihalohydrins with one or more nitrogen containing compounds selected from certain substituted pyridines, quinolione or aminoquinoline, isoquinoline or benzimidazole. Reaction products of imidazoles are not disclosed. This patent fails to disclose the copper plating of small features in substrates used in the manufacture of integrated circuits.

The use of leveling agents in semiconductor manufacture is known but such agents are known to provide poor fill performance of small features, such as vias and trenches. For example, known leveling agents that have been used in semiconductor manufacture form substantially planar surfaces, however, they also form a substantial number of voids in the vias or trenches. Such voids can cause electrical open circuits in the semiconductor. As the geometries of electronic devices get smaller, the difficulty of plating a uniform copper layer while completely filling the smaller features becomes more difficult.

One proposed solution is that found in U.S. Pat. No. 6,024,857 (Reid) which discloses the use of certain leveling agents in the copper electroplating of wafers. In this patent, the leveling agents are selected such that they consist essentially of molecules having a size at least equal to the width of the feature to be plated. Such leveling agents are macromolecules, having molecular weights of from 200,000 to 10,000,000. Such an approach is problematic when features of different sizes are present in the same substrate. Also, such leveling agents are so large that they are removed from the plating baths during normal filtration processes to remove particulates.

Thus, there is a need in the art for leveling agents for use in semiconductor manufacture that do not form voids, show reduced overplating and are useful for plating substrates having different sized features.

SUMMARY OF THE INVENTION

It has been surprisingly found that the present invention provides metal layers, particularly copper layers, having reduced overplating. The metal layers provided by the present invention are substantially planar, even on substrates having very small features and substrates having a variety of feature sizes. It has been further surprisingly found that the present invention provides metal layers substantially without the formation of added defects, such as voids, in the features, and in particular copper layers without the formation of defects, such as voids, in very small features. The present invention also provides copper deposits that are essentially level over the plated area.

The present invention provides compounds that function as both leveling agents and suppressors in metal plating baths, and particularly in copper electroplating baths. These dual-functioning compounds contain a first moiety capable of providing a level copper deposit, a second moiety capable of suppressing copper plating and optionally a spacer group. In particular, these compounds are a reaction product of a compound containing one or more heteroatoms selected from the group consisting of sulfur, nitrogen and a combination of sulfur and nitrogen, a spacer group and an alkylene oxide.

Also provided by the present invention is a copper plating bath composition including a source of copper ions, an electrolyte and an additive compound including a first moiety capable of providing a level copper deposit, a second moiety capable of suppressing copper plating and optionally a spacer group. The leveling agents are capable of providing a substantially planar copper layer and filling variously sized features without substantially forming defects.

In another aspect the present invention provides a method of depositing copper on a substrate including the steps of: contacting a substrate to be plated with copper with the copper plating bath described above; and then applying a current density for a period of time sufficient to deposit a copper layer on the substrate. In still another aspect, the present invention provides a method of manufacturing an electronic device including the steps of: contacting an electronic device substrate with the copper plating bath described above; and then applying a current density for a period of time sufficient to deposit a copper layer on the substrate.

In a further aspect, the present invention provides a method of providing a copper layer having reduced overplating on an integrated circuit device including the steps of: contacting an integrated circuit substrate with the copper electroplating bath described above; and subjecting the bath to a current density and for a period of time sufficient to deposit a copper layer on the substrate.

Further provided by the present invention is a method of preparing a reaction product including the steps of: a) combining an amine, an alkylene oxide compound and water in a reaction vessel; b) adding a spacer group compound to the combination to form a reaction mixture; and c) reacting the reaction mixture at a temperature and for a period of time sufficient to provide a reaction product.

DETAILED DESCRIPTION OF THE INVENTION

Figure 1:
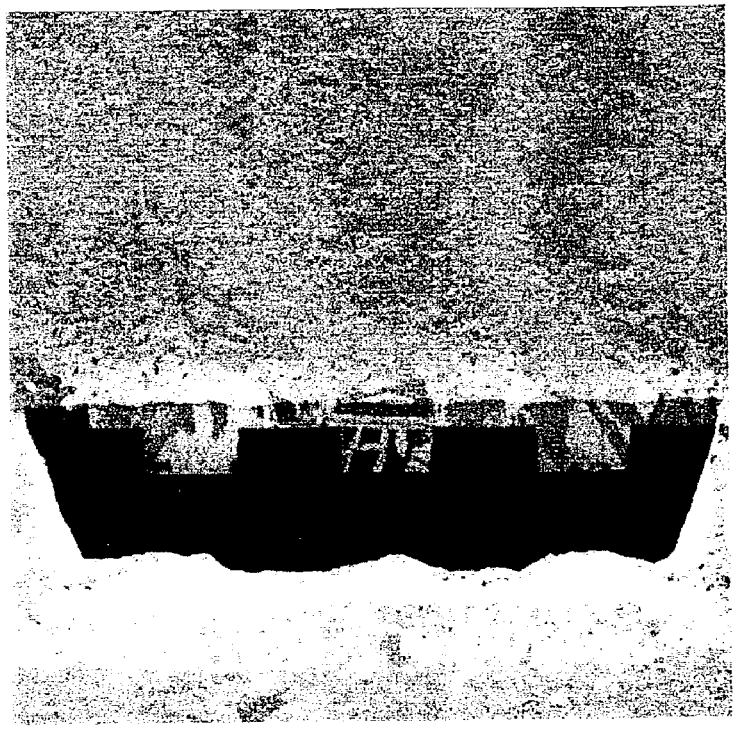
FIG. 1 is a scanning electron micrograph ("SEM") of a copper layer plated over 2 μm features using a leveling agent of the invention.

As used throughout this specification, the following abbreviations shall have the following meanings, unless the context clearly indicates otherwise: A=amperes; $mA/cm^2$=milliamperes per square centimeter; ° C.=degrees Centigrade; g=gram; mg=milligram; Å=angstrom; L=liter, ppm=parts per million; ppb=parts per billion; μm=micron=micrometer; cm=centimeter; RPM=revolutions per minute; DI=deionized; and mL=milliliter. All amounts are percent by weight and all ratios are by weight, unless otherwise noted. All numerical ranges are inclusive and combinable in any order, except where it is obvious that such numerical ranges are constrained to add up to 100%.

As used throughout the specification, "feature" refers to the geometries on a substrate, such as, but not limited to, trenches and vias. "Apertures" refer to recessed features, such as vias and trenches. The term "small features" refers to features that are one micron or smaller in size. "Very small features" refers to features that are one-half micron or smaller in size. Likewise, "small apertures" refer to apertures that are one micron or smaller (≦1 μm) in size and "very small apertures" refer to apertures that are one-half micron or smaller (≦0.5 μm) in size. As used throughout this specification, the term "plating" refers to metal electroplating, unless the context clearly indicates otherwise. "Deposition" and "plating" are used interchangeably throughout this specification. "Halide" refers to fluoride, chloride, bromide and iodide. Likewise, "halo" refers to fluoro, chloro, bromo and iodo. The term "alkyl" includes linear, branched and cyclic alkyl. "Brightener" refers to an organic additive that increases the plating rate of the electroplating bath. The terms "brightener" and "accelerator" are used interchangeably throughout this specification. "Suppressors", which are also known as "carriers", refer to organic additives that suppresses the plating rate of a metal during electroplating. "Leveler" refers to an organic compound that is capable of providing a substantially planar metal layer. The terms "levelers" and "leveling agents" are used interchangeably throughout this specification.

The present invention provides an essentially level plated metal layer, particularly a plated copper layer, on a substrate. When the substrate contains small features, the plated metal layers of this invention has reduced overplating and the small features, which are also plated with metal, are substantially free of added voids, and preferably substantially free of voids. "Overplating" refers to a thicker metal deposit over dense feature areas as compared to areas free of features or at least containing relatively few features. The term "relatively few features" means an area containing up to 10%, and preferably up to 5%, of the total number of features of a comparative area having many such features, "dense feature areas", within the same device. Such difference in the plating thickness over dense feature areas as compared to the plating thickness over areas free of features or containing relatively few features is referred to as "step height."

Any substrate upon which a metal, particularly copper, can be electroplated is useful in the present invention. Such substrates include, but are not limited to, printed wiring boards, integrated circuits, semiconductor packages, lead frames, interconnects, and the like. Particularly useful substrates are any used in the manufacture of electronic devices, such as integrated circuits, and more particularly wafers used in dual damascene manufacturing processes. Such substrates typically contain a number of features, particularly apertures, having a variety of sizes. For example, integrated circuit substrates may contain apertures ranging from 100 μm to as little as 50 nm or 25 nm or less. In one embodiment, it is preferred that the substrate contains small features, and preferably very small features. Such small features may be present in the substrate along with larger features, such as 100 μm features. For example, an integrated circuit substrate may contain 0.2 μm as well as 2 μm, or even larger features. It is further preferred that the features that are filled by copper deposited from the instant plating baths are free of added voids. It will be appreciated by those skilled in the art that other substrates to be plated, such as lead frames and printed wiring boards, may have larger or smaller features or no features at all. The present invention is particularly suitable for filling vias of varying aspect ratios, such as low aspect ratio vias and high aspect ratio vias. By "low aspect ratio" is meant an aspect ratio of from 0.1:1 to 4:1. The term "high aspect ratio" refers to aspect ratios of 4:1 or greater such as 10:1 or 20:1.

The present invention is achieved by combining one or more of the present organic additive compounds with a metal electroplating bath, preferably a copper electroplating bath. Such plating bath typically includes a source of copper ions, an electrolyte and an additive compound including a first moiety capable of providing a level copper deposit, a second moiety capable of suppressing copper plating and optionally a spacer group. The present organic additives are compounds capable of having a dual-function. Such "dual-function" additives are capable of functioning as a leveling agent or a suppressor or as both a leveling agent and a suppressor in a copper plating bath. Dual-function additives (or compounds) of the invention are typically contain a first moiety capable of providing a level copper deposit, a second moiety capable of suppressing copper plating and optionally a spacer group. In general, the present dual-function compounds are reaction products of a compound capable of providing a level copper deposit, a compound capable of suppressing copper plating and optionally a spacer group. The reaction products may be polymeric, oligomeric or essentially monomeric, i.e. simple reaction products of 1 or 2 molecules of each component.

Compounds capable of providing a level copper deposit are well-known in the art and represent the moiety capable of providing a level copper deposit ("leveling moiety") in the present invention. While not intending to be bound by theory, it is believed such moieties are attracted to copper surfaces by strong, but not irreversible, attractions. Such attractions are believed to include coordinative interactions, electrostatic interactions or both. In general, compounds capable of providing a level copper deposit are those containing one or more heteroatoms selected from the group consisting of sulfur, nitrogen and a combination of sulfur and nitrogen. Exemplary sulfur-containing leveling compounds include thiourea and substituted thioureas. Amines are preferred as such leveling moieties. Primary, secondary and tertiary amines may be used, with secondary and tertiary amines being preferred. Cyclic amines are most preferred as they have a very strong affinity for copper films. Suitable amines include, but are not limited to, dialkylamines, trialkylamines, arylalkylamines, diarylamines, imidazole, triazole, tetrazole, benzimidazole, benzotriazole, piperidine, morpholine, piperazine, pyridine, oxazole, benzoxazole, pyrimidine, quonoline, isoquinoline, and the like. Imidazole and pyridine are preferred and imidazole is most preferred. The above amines may be unsubstituted or substituted. By "substituted", it is meant that one or more of the hydrogens are replaced by one ore more substituent groups. A wide variety of substituent groups may be used, including amino, alkylamino, dialkylamino, alkyl, aryl, alkenyl, alkoxyl, and halo. It will be appreciated by those skilled in the art that more than one moiety capable of coordinating with copper may be used. In particular, mixtures of amines may be advantageously employed, such as a mixture of imidazole and methylimidazole or a mixture of imidazole and pyridine.

A wide variety of compounds capable of suppressing copper plating are known and any of these may be used as the suppressor moiety in the present invention. Exemplary of such compounds include, but are not limited to alkylene oxide compounds. A wide variety of alkylene oxide moieties may be used. The term "alkylene oxide" refers to ($C_1$–$C_6$) alkyl oxiranes such as ethylene oxide, propylene oxide and butylene oxide as well as to ring opened reaction products of these oxiranes, such as glycols including polyalkylene glycols, monoalkyl alkyleneglycol ethers including monoalkyl polyalkylene glycol ethers and monoaryl alkyleneglycol ethers including monoaryl polyalkyleneglycol ethers, as well as mixtures of any of these. Exemplary glycols include, but are not limited to, ethylene glycol, diethylene glycol, triethylene glycol and its higher homologs, i.e. polyethylene glycol, propylene glycol, dipropylene glycol, tripropylene glycol and its higher homologs, i.e. polypropylene glycol, and butylenes glycol and its higher homologs, i.e. polybutylene glycol. Mixtures of alkylene oxide moieties may be used. For example, a mixture of diethylene glycol and triethylene glycol, a mixture of diethylene glycol and dipropylene glycol, a mixture of ethylene glycol and diethylene glycol, an ethyleneoxy ("EO")/propyleneoxy ("PO") copolymer or an EO/butyleneoxy ("BO") copolymer may be used. The EO/PO and EO/BO copolymers may be alternating, random or block copolymers.

In one embodiment, a particularly useful alkylene oxide moiety is one having three or more different ether linkages. By "different ether linkages" it is meant chemically distinguishable ether linkages. An example of such an alkylene oxide compound is a compound including EO groups, PO groups and a third ether linkage, such as ($C_1$–$C_4$)alkoxy or phenoxy. Such alkylene oxy compounds are represented by the formula $-(EO)_n(PO)_mOR$, wherein R is ($C_1$–$C_4$)alkyl, phenyl, or bisphenol A, n and m are independently integers of from 1 to 3000, and wherein the order of the EO and PO groups may be in any order.

The glycols typically have a molecular weight from approximately 100 up to several hundred thousand. Particularly useful polyalkylene glycols, such as polyethylene, polypropylene, and polybutylene glycols, as well as poly (EO/PO) copolymers, poly(EO/BO) copolymers or poly (BO/PO) copolymers, have a molecular weight of 100 to 25,000, preferably 250 to 15,000 and most preferably 400 to 10,000. In general, the higher the molecular weight of the alkylene oxide moiety used in the compounds of present invention, the better the compound functions as a suppressor. For example, the present compounds containing an alkylene oxide moiety having a molecular weight of ≧2000 function very well as both a leveling agent and a suppressing agent across a wide range of concentrations for a given copper plating bath. When the present compounds contain an alkylene oxide moiety having a molecular weight <2000, the compound may have a more pronounced leveling affect, but still provides an effective suppressor function. The desired balance of leveling and suppressing functions of these compounds may be tailored by selecting an alkylene oxide moiety of a certain molecular weight, as well as the ratio of the first moiety capable of providing a level copper deposit to the second moiety capable of suppressing copper plating. Such selection is within the ability of those skilled in the art.

A "spacer group", as used herein, refers to any compound that is reacted with the copper coordinating moiety and the alkylene oxide moiety to form the present reaction products. While such spacer groups are optional, they are preferred. Suitable spacer groups are those of formula (I)

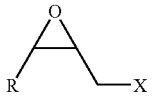

(I)

wherein X=halogen and R=H and ($C_1$–$C_{12}$)alkyl. Preferably, the halogen is chlorine or bromine, and more preferably chlorine. The ($C_1$–$C_{12}$)alkyl group may be unsubstituted or substituted, i.e. one or more of its hydrogens may be replaced with another substituent group. Suitable substituent groups include ($C_1$–$C_6$)alkoxy, $R^1(OC_yH_{2y})_nO$, and epoxy-substituent ($C_2$–$C_{24}$)alkyl wherein $R_1$=H, phenyl or ($C_1$–$C_6$) alkyl; y=1–4; and n=1–100. Preferably, y=2 or 3. In one embodiment, the spacer groups do not function to coordinate with copper nor do they function to suppress the plating rate, to any appreciable extent. Preferred spacer groups are epihalohydrins, such as epichlorohydrin and epibromohydrin. Epichlorohydrin is the most preferred spacer group. Mixtures of spacer groups may also be used to prepare the present reaction products.

The reaction product is prepared by reacting, for example, epichlorohydrin with a cyclic amine and an alkylene oxide moiety under any suitable reaction conditions. In one method, the cyclic amine, alkylene oxide moiety and epichlorohydrin are dissolved in the same solvent in desired concentrations and reacted, such as for 40 to 240 minutes.

The solvent is typically removed, such as under vacuum, to provide a water-soluble reaction product. In a preferred embodiment, the desired amounts of amine and alkylene oxide moiety are combined with water in a reaction vessel. The solution is stirred and the temperature of the solution may be from ambient to the reflux temperature of water (100° C.). Preferably, the temperature of the solution at this step is from 40° to 99° C. and more preferably from 70° to 90° C. A desired amount of the spacer group compound is next added to stirred reaction mixture. The reaction need not be heated at this time as the reaction with epichlorohydrin is exothermic. Alternatively, the epichlorohydrin may be added slowly while the reaction mixture is heated, such as from 40° to 95° C., to increase the rate of the reaction. Higher or lower temperatures may be used at this stage. The reaction mixture is maintained at this temperature until the pH of the reaction mixture is in the range of 7 to 8. Typically, this reaction is complete within 1 to 24 hours and preferably 8 to 16 hours. The exact reaction time will depend upon the particular reactants selected, the concentration of the reactants in the reaction mixture and the particular temperatures are used. Accordingly, the present invention provide a method of preparing a reaction product including the steps of: a) combining an amine, an alkylene oxide compound and water in a reaction vessel; b) adding a spacer group compound to the combination to form a reaction mixture; and c) reacting the reaction mixture at a temperature and for a period of time sufficient to provide a reaction product.

The leveling moiety, the suppressor moiety and optionally the spacer group may be combined in a wide range of ratios. For example, molar ratios of leveling moiety to suppressor moiety may range from 1:5000 to 10:1, preferably 1:3000 to 10:1, and more preferably from 1:500 to 2:1. Likewise, the molar ratios of the leveling moiety to spacer group compound may range from 10:1 to 1:10 preferably from 5:1 to 1:5 and more preferably 3:1 to 1:3. When the copper coordinating moiety is a cyclic amine such as imidazole and the spacer group compound is epichlorohydrin, particularly useful molar ratios of cyclic amine:alkylene oxide:epichlorohydrin are 1:1:1, 1:2:1, 1:2:2, 2:1:2, 2:2:1 and the like. Particularly preferred reaction products having these ratios are reaction products of a) imidazole or pyridine with b) diethylene glycol, a polyethylene glycol, an EO/PO copolymer or an EO/BO copolymer with c) epichlorohydrin.

As discussed above, the present reaction products are dual-functioning, i.e. as leveling agents and as suppressors. These dual-function compounds are capable of providing a substantially planar copper layer and filling variously sized features, particularly small features, without substantially forming voids and are useful in any copper plating bath. These reaction products may contain additional substitution, such as to improve their solubility in the plating baths, however, such substitution is not necessary. In particular, sulfonic acid functionality on these compounds does not add to their function as either levelers or suppressors and is not needed. It is preferred that the present reaction products are free of sulfonic acid groups. It is further preferred that the alkylene oxide moiety is free of halogen substitution.

The dual-functioning reaction products of the present invention may be used in a copper plating bath in any suitable amount. The particular amount used will depend upon the particular reaction product selected, the concentration of the copper and the acid in the plating bath and the current density used to deposit the copper, as well as whether a leveling function, a suppressing function or both functions is desired. In general, the present compounds are used in a total amount of from 0.5 ppm to 10,000 ppm based on the total weight of the plating bath, although greater or lesser amounts may be used. It is preferred that the total amount of these compounds is from 1 to 5000 ppm and more preferably from 5 to 1000 ppm. A particularly useful amount of these dual-functioning reaction products is from 10 to 250 ppm. It is preferred that as the amount of leveling agent is increased in the plating bath that the amount of brightener is also increased. Amounts of leveling agent greater than 1 ppm are particularly useful in certain plating baths.

In general, the present metal electroplating baths include electrolyte, preferably acidic electrolyte, one or more sources of metal ions, one or more brighteners and optionally other additives. Such baths are typically aqueous. Suitable electrolytes are acids and include, but are not limited to, sulfuric acid, acetic acid, fluoroboric acid, alkylsulfonic acids such as methanesulfonic acid, ethanesulfonic acid, propanesulfonic acid and trifluoromethane sulfonic acid, arylsulfonic acids such as phenyl sulfonic acid, phenol sulfonic acid and toluenesulfonic acid, sulfamic acid, hydrochloric acid, phosphoric acid and the like. Mixtures of acids may be advantageously used in the present metal plating baths. Preferred acids include sulfonic acid, methanesulfonic acid, ethanesulfonic acid, propanesulfonic acid, and mixtures thereof. Such electrolytes are generally commercially available from a variety of sources and may be used without further purification. The acids are typically present in an amount in the range of from 1 to 300 g/L, preferably from 5 to 250 g/L, and more preferably from 10 to 180 g/L.

For certain applications, such as in the plating of wafers having very small apertures, it may be desired that the total amount of added acid be low. By "low acid" is meant that the total amount of added acid in the electrolyte is less than or equal to 20 g/L, and preferably less than or equal to 10 g/L.

Such electrolytes may optionally contain a source of halide ions, such as chloride ions such as copper chloride or hydrochloric acid. A wide range of halide ion concentrations may be used in the present invention. Typically, the halide ion concentration is in the range of from 0 to 100 ppm based on the plating bath, and preferably from 10 to 75 ppm. A particularly useful amount of halide ion is 20 to 75 ppm and more particularly 20 to 50 ppm. Such halide ion sources are generally commercially available and may be used without further purification.

Any metal ion source that is at least partially soluble in the electroplating bath and which metal can be deposited electrolytically is suitable. It is preferred that the metal ion source is soluble in the plating bath. Suitable metal ion sources are metal salts and include, but are not limited to, metal sulfates, metal halides, metal acetates, metal nitrates, metal fluoroborates, metal alkylsulfonates, metal arylsulfonates, metal sulfamates, metal gluconates and the like. It is preferred that the metal is copper. It is further preferred that the source of metal ions is copper sulfate, copper chloride, copper acetate, copper nitrate, copper fluoroborate, copper methane sulfonate, copper phenyl sulfonate and copper p-toluene sulfonate. Copper sulfate pentahydrate is particularly preferred. Such metal salts are generally commercially available and may be used without further purification.

The metal salts may be used in the present invention in any amount that provides sufficient metal ions for electroplating on a substrate. Suitable metal salts include, but are not limited to, tin salts, copper salts, and the like. When the metal is copper, the copper salt is typically present in an amount sufficient to provide an amount of copper metal of 10 to 180 g/L of plating solution. It will be appreciated that mixtures of metal salts may be used and deposited according to the present invention. Thus, alloys, such as copper-tin having up to 2 percent by weight tin, may be advantageously plated according to the present invention. Other suitable copper alloys include, but are not limited to copper-silver, tin-copper-silver, tin-copper-bismuth, and the like. The amounts of each of the metal salts in such mixtures depends upon the particular alloy to be plated and is well known to those skilled in the art.

Any brighteners or brightening agents are suitable for use in the present invention. Such brighteners are well-known to those skilled in the art. Typical brighteners contain one or more sulfur atoms and have a molecular weight of 1000 or less. Brightener compounds that have sulfide and/or sulfonic acid groups are generally preferred, particularly compounds that include a group of the formula R'—S—R—$SO_3X$, where R is optionally substituted alkyl, optionally substituted heteroalkyl, optionally substituted aryl, or optionally substituted heterocyclic; X is a counter ion such as sodium or potassium; and R' is hydrogen or a chemical bond. Typically, the alkyl groups are ($C_1$–$C_{16}$)alkyl and preferably ($C_3$–$C_{12}$)alkyl. Heteroalkyl groups typically have one or more heteroatoms, such as nitrogen, sulfur or oxygen, in the alkyl chain. Suitable aryl groups include, but are not limited to, phenyl, benzyl, biphenyl and naphthyl. Suitable heterocyclic groups typically contain from 1 to 3 heteroatoms, such as nitrogen, sulfur or oxygen, and 1 to 3 separate or fused ring systems. Such heterocyclic groups may be aromatic or non-aromatic. Specific brighteners suitable for use in the present invention include, but are not limited to, N,N-dimethyl-dithiocarbamic acid-(3-sulfopropyl)ester; 3-mercapto-propylsulfonic acid-(3-sulfopropyl)ester; 3-mercapto-propylsulfonic acid sodium salt; carbonic acid-dithio-o-ethylester-s-ester with 3-mercapto-1-propane sulfonic acid potassium salt; bis-sulfopropyl disulfide; 3-(benzothiazolyl-s-thio)propyl sulfonic acid sodium salt; pyridinium propyl sulfobetaine; 1-sodium-3-mercaptopropane-1-sulfonate; N,N-dimethyl-dithiocarbamic acid-(3-sulfoethyl)ester; 3-mercapto-ethyl propylsulfonic acid-(3-sulfoethyl)ester; 3-mercapto-ethylsulfonic acid sodium salt; carbonic acid-dithio-o-ethylester-s-ester with 3-mercapto-1-ethane sulfonic acid potassium salt; bis-sulfoethyl disulfide; 3-(benzothiazolyl-s-thio)ethyl sulfonic acid sodium salt; pyridinium ethyl sulfobetaine; 1-sodium-3-mercaptoethane-1-sulfonate, and the like.

Such brighteners may be used in a variety of amounts typically are used in an amount of at least 1 mg/L, based on the bath, preferably at least 1.2 mg/L, and more preferably at least 1.5 mg/L. For example, the brighteners are present in an amount of from 1 mg/L to 200 mg/L. Particularly suitable amounts of brightener useful in the present invention are at least 2 mg/L, and more particularly at least 4 g/L. Even higher brightener concentrations are preferred, such as at least 10, 15, 20, 30, 40 or 50 mg/L, based on the bath. A particularly useful range of such brightener concentrations is from 5 to 50 mg/L.

In addition to the present dual-function compounds, other organic additives such as additional leveling agents-and-additional suppressor compounds may be used in copper plating baths. For example, although they are not necessary, one or more additional leveling agents (compounds that functions only as leveling agents and not as suppressors) may be used. Preferably such additional leveling agents are not used. Suitable additional leveling agents that may be combined with the present dual-function compounds include, but are not limited to, one or more of nigrosines, pentamethyl-para-rosaniline hydrohalide, hexamethyl-para-rosaniline hydrohalide, reaction products of an amine with an epihalohydrin, or compounds containing a functional group of the formula N—R—S, where R is a substituted alkyl, unsubstituted alkyl, substituted aryl or unsubstituted aryl. Typically, the alkyl groups are ($C_1$–$C_6$)alkyl and preferably ($C_1$–$C_4$)alkyl. In general, the aryl groups include ($C_6$–$C_{20}$)aryl, preferably ($C_6$–$C_{10}$)aryl. Such aryl groups may further include heteroatoms, such as sulfur, nitrogen and oxygen. It is preferred that the aryl group is phenyl or napthyl. The compounds containing a functional group of the formula N—R—S are generally known, are generally commercially available and may be used without further purification.

In such above compounds containing the N—R—S functional group, the sulfur ("S") and/or the nitrogen ("N") may be attached to such compounds with single or double bonds. When the sulfur is attached to such compounds with a single bond, the sulfur will have another substituent group, such as but not limited to hydrogen, ($C_1$–$C_{12}$)alkyl, ($C_2$–$C_{12}$)alkenyl, ($C_6$–$C_{20}$)aryl, ($C_1$–$C_{12}$)alkylthio, ($C_2$–$C_{12}$)alkenylthio, ($C_6$–$C_{20}$)arylthio and the like. Likewise, the nitrogen will have one or more substituent groups, such as but not limited to hydrogen, ($C_1$–$C_{12}$)alkyl, ($C_2$–$C_{12}$)alkenyl, ($C_7$–$C_{10}$)aryl, and the like. The N—R—S functional group may be acyclic or cyclic. Compounds containing cyclic N—R—S functional groups include those having either the nitrogen or the sulfur or both the nitrogen and the sulfur within the ring system.

By "substituted alkyl" is meant that one or more of the hydrogens on the alkyl group is replaced with another substituent group, such as, but not limited to, cyano, hydroxy, halo, ($C_1$–$C_6$)alkoxy, ($C_1$–$C_6$)alkylthio, thiol, nitro, and the like. By "substituted aryl" is meant that one or more hydrogens on the aryl ring are replaced with one or more substituent groups, such as, but not limited to, cyano, hydroxy, halo, ($C_1$–$C_6$)alkoxy, ($C_1$–$C_6$)alkyl, ($C_2$–$C_6$)alkenyl, ($C_1$–$C_6$)alkylthio, thiol, nitro, and the like. "Aryl" includes carbocyclic and heterocyclic aromatic systems, such as, but not limited to, phenyl, naphthyl and the like.

Such additional suppressors and surfactants are generally known in the art. It will be clear to one skilled in the art which suppressors and/or surfactants to use and in what amounts. One of the advantages of the present invention is that such additional suppressors, while they might be beneficial in certain applications, are not required. From ease of bath component control, it is preferred that such additional suppressors are not used.

Additional suppressors useful in the present invention include, but are not limited to, polymeric materials, particularly those having heteroatom substitution, and more particularly oxygen substitution. It is preferred that the suppressor is a high molecular weight polyether, such as those of the formula:

$$R—O—(CXYCX'Y'O)_nH$$

where R is a ($C_2$–$C_{20}$)alkyl group or ($C_6$–$C_{10}$)aryl group; each of X, Y, X' and Y' is independently selected from hydrogen, alkyl such as methyl, ethyl or propyl, aryl such as phenyl, or aralkyl such as benzyl; and n is an integer from 5 to 100,000. It is preferred that one or more of X, Y, X' and Y' is hydrogen. It is further preferred that R is ethylene. It is more preferred that R is ethylene and n is greater than 12,000. Particularly suitable suppressors include commercially available polyethylene glycol copolymers, including ethylene oxide-propylene oxide copolymers and butyl alcohol-ethylene oxide-propylene oxide copolymers. Suitable butyl alcohol-ethylene oxide-propylene oxide copolymers are those having a weight average molecular weight of 1800. When such additional suppressors are used, they are typically present in an amount in the range of from 1 to 10,000 ppm based on the weight of the bath, and preferably from 5 to 10,000 ppm.

Particularly suitable compositions useful as electroplating baths in the present invention include one or more soluble copper salts, one or more acids, one or more dual-functioning reaction products and one or more brighteners. More particularly suitable compositions include 10 to 180 g/L of one or more soluble copper salts as copper metal, 5 to 250 g/L of one or more acids, 5 to 50 mg/L of one or more brighteners, 15 to 75 ppm of a halide ion, 1 to 5000 ppm of a reaction product of an amine, particularly imidazole, with an alkylene oxide and epichlorohydrin. It is preferred that the present plating baths are free of additional suppressors. It is further preferred that the present plating baths are free of additional leveling agents.

The electroplating baths of the present invention may be prepared by combining the components in any order. It is preferred that the inorganic components such as metal salts, water, acid and optional halide ion source, are first added to the bath vessel followed by the organic components such as leveling agents, brighteners, suppressors, surfactants and the like.

Typically, the plating baths of the present invention may be used at any temperature from 10° to 65° C. or higher. It is preferred that the temperature of the plating baths is from 10° to 35° C. and more preferably from 15° to 30° C.

In general, when the present invention is used to deposit metal on a substrate such as a wafer used in the manufacture of an integrated circuit, the plating baths are agitated during use. Any suitable agitation method may be used with the present invention and such methods are well-known in the art. Suitable agitation methods include, but are not limited to, air sparging, work piece agitation, impingement and the like. Such methods are known to those skilled in the art. When the present invention is used to plate an integrated circuit substrate, such as a wafer, the wafer may be rotated such as from 1 to 150 RPM and the plating solution contacts the rotating wafer, such as by pumping or spraying. In the alternative, the wafer need not be rotated where the flow of the plating bath is sufficient to provide the desired metal deposit.

Typically, substrates are electroplated by contacting the substrate with the plating baths of the present invention. The bath is typically subjected to a current density for a period of time sufficient to deposit a copper layer on the substrate. Suitable current densities, include, but are not limited to, the range of 1 to 100 mA/cm$^2$. It is preferred that the current densities are from 1 to 60 mA/cm$^2$. The specific current density depends upon the substrate to be plated, the leveling agent selected and the like. Such current density choice is within the skill of one in the art.

The present invention is useful for depositing a layer of copper on a variety of substrates, particularly those having variously sized apertures. Accordingly, the present invention provides a method of depositing copper on a substrate including the steps of: contacting a substrate to be plated with copper with a copper plating bath; and then applying a current density for a period of time sufficient to deposit a copper layer on the substrate, wherein the copper plating bath includes a source of copper ions, an acid and a compound including a first moiety capable of providing a level copper deposit, a second moiety capable of suppressing copper plating and optionally a spacer group. For example, the present invention is particularly suitable for depositing copper on integrated circuit substrates, such as semiconductor devices, with small diameter, high aspect ratio vias, trenches or other apertures. In one embodiment, it is preferred that semiconductor devices are plated according to the present invention. Such semiconductor devices include, but are not limited to, wafers used in the manufacture of integrated circuits.

In particular, the present invention provides a method for manufacturing an electronic device, such as an integrated circuit, including the steps of: contacting an electronic device substrate with a copper plating bath; and then applying a current density for a period of time sufficient to deposit a copper layer on the substrate, wherein the copper plating bath includes a source of copper ions, an acid and a compound including a first moiety capable of providing a level copper deposit, a second moiety capable of suppressing copper plating and optionally a spacer group. More particularly, the present invention provides a method for manufacturing an integrated circuit comprising the steps of: contacting an electronic device substrate with a copper plating bath; and then applying a current density for a period of time sufficient to deposit a copper layer on the substrate, wherein the copper plating bath includes 10 to 180 g/L as copper metal of one or more soluble copper salts, 5 to 250 g/L of one or more acids, 5 to 50 mg/L of one or more brighteners, 15 to 75 ppm of a halide ion, 1 to 5000 ppm of a reaction product of an amine with an alkylene oxide and epihalohydrin. Preferably, the amine is imidazole. Copper is deposited in features without substantially forming voids according to the present methods. By the term "without substantially forming voids" it is meant that >95% of the plated features are void-free. It is preferred that the plated features are void-free.

While the process of the present invention has been generally described with reference to semiconductor manufacture, it will be appreciated that the present invention may be useful in any electrolytic process where an essentially level or planar copper deposit having high reflectivity is desired, and where reduced overplating and metal filled small features that are substantially free of voids are desired. Such processes include printed wiring board manufacture. For example, the present plating baths may be useful for the plating of vias, pads or traces on a printed wiring board, as well as for bump plating on wafers. Other suitable processes include packaging and interconnect manufacture. Accordingly, suitable substrates include lead frames, interconnects, printed wiring boards, and the like.

An advantage of the present invention is that overplating is reduced or substantially eliminated. Such reduced overplating means less time and effort is spent in removing metal, such as copper, during subsequent chemical-mechanical polishing ("CMP") process, particularly in semiconductor manufacture. A further advantage of the present invention is that a wide range of apertures sizes may be fill within a single substrate with substantially no suppressed local plating. Thus, the present invention is particularly suitable to substantially filling apertures in a substrate having a variety of aperture sizes, such as from 0.18 μm to 100 μm.

The reaction products of the present invention have a large concentration range over which they function as leveling agents. Such concentration range is made wider than that of conventional leveling agents, such as reaction products of imidazole and epichlorohydrin alone. If only a narrow concentration range provides the desired leveling results, then the plating bath must often or continually be analyzed to ensure the concentration of the leveling agents is within the working range. The wider working concentration range of the present leveling agents allow for less frequent bath analysis.

A still further advantage of the present compounds is that they provide metal deposits having less surface roughness and higher reflectivity, as measured by atomic force microscopy ("AFM"), as compared to conventional leveling agents. For example, layers of copper deposited from the present plating baths have a reflectivity ("Rf") of ≧140 and preferably ≧150, as compared to a polished silicon wafer reference, Rf of the wafer set to 100. Such copper layers typically have an arithmetic average roughness ("Ra") of ≦5 nm and preferably <5 nm. These copper layers also have a low Z-value, such as ≦70, preferably ≦50 and more preferably ≦40. The "Z-value" is the difference in heights in nm of the average of the 10 height and 10 lowest points examined. The lower the Z-value, the more uniform the surface of the copper layer. Further, the copper layers deposited using the present plating baths typically have a root mean square roughness ("Rs") of ≦5 nm and preferably <5 nm.

Figure 2:
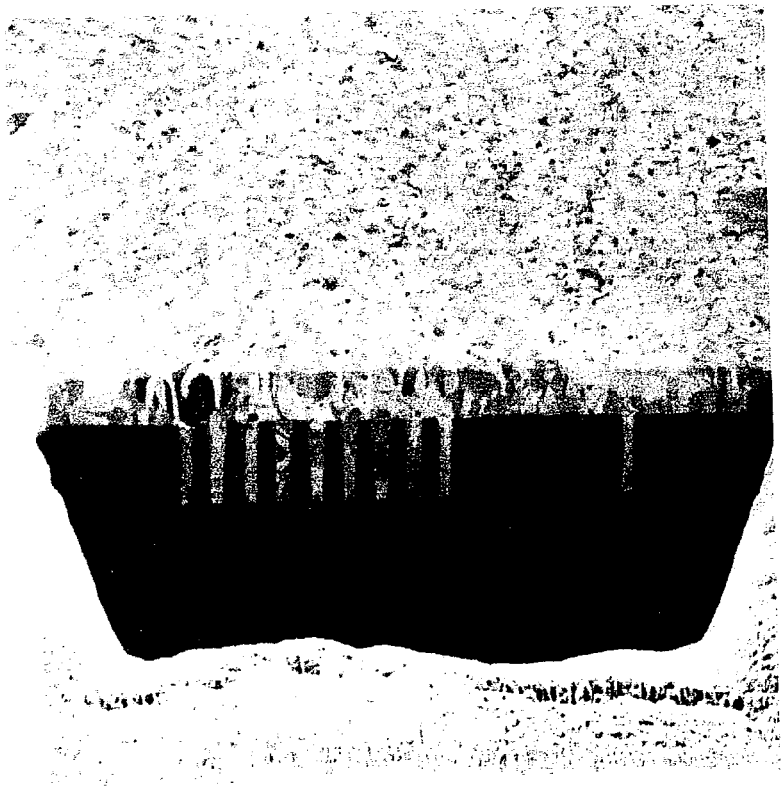
FIG. 2 is a SEM of a copper layer plated over 0.2 μm features using a leveling agent of the invention.
Figure 3:
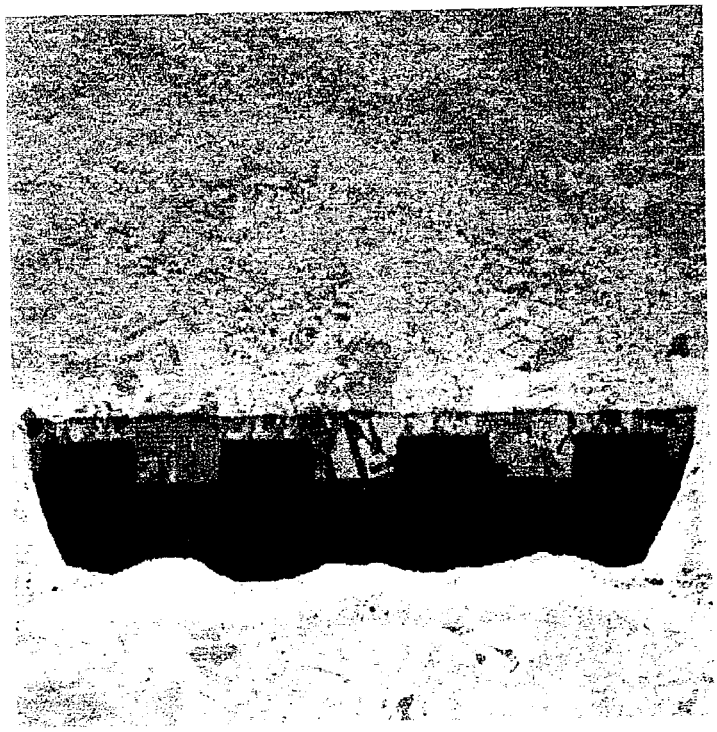
FIG. 3 is a SEM of a copper layer plated over 2 μm features using a leveling agent of the invention.
Figure 4:
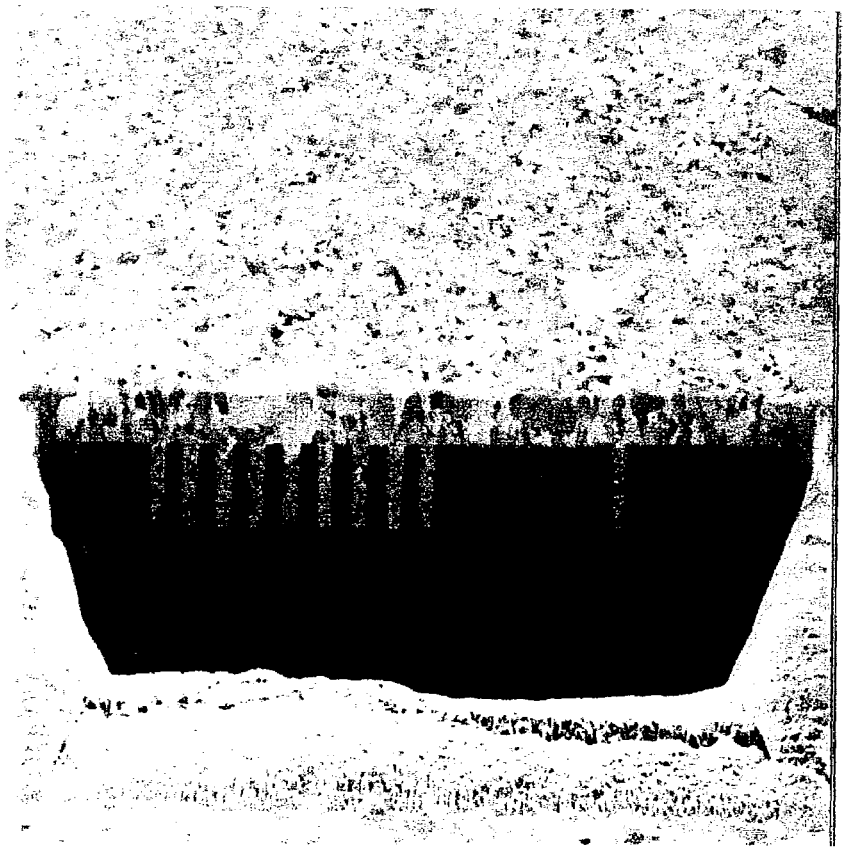
FIG. 4 is a SEM of a copper layer plated over 0.2 μm features using a leveling agent of the invention.

The present compounds provide level metal deposits over a wide range of feature sizes. For example, FIGS. 1 and 2 are SEMs showing a layer of copper plated over 2 μm and 0.2 μm features, respectively, using a plating bath containing a compound of the invention. FIGS. 3 and 4 are SEMs showing a layer of copper plated over 2 μm and 0.2 μm features, respectively, using a copper plating bath containing a compound of the invention. These figures clearly show that the present compounds function as leveling agents provide level deposits over a wide variety of feature sizes with essentially no overplating.

Thus, electronic devices such as semiconductor devices, semiconductor packages, printed circuit boards and the like, are formed according to the present invention having substantially planar copper layers and filled features that are substantially free of added defects, wherein the copper layer has not been subjected to polishing processes, such as a CMP process, electropolishing or silmultaneous plating and planarization techniques. By "substantially planar" copper layer is meant that the step height difference between areas of dense very small features and areas free of or substantially free of very small features is less than 1 μm, preferably less than 0.75 μm, more preferably less than 0.6 μm, and even more preferably less than 0.1 μm. "Substantially free of added defects" refers to the leveling agent not increasing the number or size of defects, such as voids, in very small features as compared to control plating baths not containing such leveling agent. A further advantage of the present invention is that a substantially planar metal layer may be deposited on a substrate having non-uniformly sized small features, wherein the features are substantially free of added voids, with the use of a single leveling agent. "Non-uniformly sized small features" refer to small features having a variety of sizes in the same substrate. Thus, the need to tailor the leveling agent to the size of the feature to be filled is avoided.

The following examples are intended to illustrate further various aspects of the present invention, but are not intended to limit the scope of the invention in any aspect.

EXAMPLE 1

A reaction product having a 2:2:1 molar ratio of imidazole:epichlorohydrin:diethylene glycol is prepared. Imidazole (2.0 g) and diethylene glycol (1.6 g) are added to a 100 mL round-bottom flask. DI water (2.5 mL) is then added to dissolve the imidazole and diethylene glycol. The flask is then placed in a water bath and is heated to 85° to 90° C. with stirring. Epichlorohydrin (2.72 g, 2.3 mol) is next added to the flask. The reaction mixture is then heated at a temperature of 90° to 98° C., with stirring, for eight hours. The heat is then turned off and the flask is allowed to cool at room temperature and is then allowed to stand overnight. A slightly yellow waxy solid is obtained, which can be used without further purification. This solid is analyzed by high pressure liquid chromatography ("HPLC") to show a polymeric reaction is obtained.

EXAMPLES 2–10

The procedure of Example 1 is repeated except that the specific alkylene oxide used and the ratio of the reactants are varied. The specific alkylene oxide compound used and the ratios of reactants are reported in Table 1.

TABLE 1

| Examples | Alkylene Oxide | Molecular Weight | Molar Ratio of Imidazole: Epichlorohydrin: Alkylene Oxide |
|---|---|---|---|
| 2 | Diethylene glycol | | 1:1:1 |
| 3 | Diethylene glycol | | 0.5:1:1 |
| 4 | Polyethylene glycol | 1000 | 1:1:0.5 |
| 5 | Polyethylene glycol | 3000 | 1:1:0.25 |
| 6 | EO/PO/EO copolymer | 1100 | 1:1:0.25 |
| 7 | EO/PO/EO copolymer | 2500 | 1:1:0.25 |
| 8 | EO/PO/EO copolymer | 1850 | 1:1:0.5 |
| 9 | EO/PO/EO copolymer | 2200 | 1:1:0.5 |
| 10 | EO/PO/EO copolymer | 2900 | 1:1:0.25 |

EXAMPLE 11

The procedure of Example 1 is repeated except that pyridine is used instead of imidazole.

EXAMPLES 12–18

Copper plating baths are prepared by combining 35 g/L copper as copper sulfate 45 g/L sulfuric acid and 45 ppm chloride ion and 10 mL/L of a brightener. A leveling agent is added to each bath. The comparative bath contains as a leveling agent a reaction product of imidazole with epichlorohydrin in a 1:1 molar ratio. The baths of Examples 12–18 do not contain any additional suppressor. The comparative bath also contains a separate suppressor, an EO/PO block copolymer having a molecular weight of 2500. The particular leveling agents and the amounts used are reported in Table 2.

Layers of copper are electroplated onto wafer substrates by contacting a spinning wafer (200 RPM) with one of the above plating baths at 25° C. A current density of 60 mA/cm2 is applied and ac copper layer is deposited on each wafer to a thickness of 1 μm. The layers of copper are analyzed by AFM to determine the reflectivity ("Rf"), root mean square roughness ("Rs"), arithmetic average roughness ("Ra") and height differential ("Z"). The reflectivity value is relative to a polished silicon wafer having an Rf value of 100. These results are reported in Table 2.

TABLE 2

| Example | Leveling Agent | Leveling Agent Concentration (ppm) | Rf | Ra (nm) | Rs (nm) | Z (nm) |
|---|---|---|---|---|---|---|
| 12 | Example 4 | 40 | 155 | 3.1 | 4.0 | 36 |
| 13 | Example 4 | 80 | 156 | 2.8 | 3.5 | 37 |
| 14 | Example 4 | 120 | 156 | 2.9 | 3.6 | 49 |
| 15 | Example 4 | 200 | 156 | 2.9 | 3.7 | 31 |
| 16 | Example 5 | 60 | 156 | 3.0 | 4.0 | 39 |
| 17 | Example 5 | 80 | 156 | 3.3 | 4.1 | 36 |
| 18 | Example 5 | 200 | 153 | 3.0 | 3.7 | 36 |
| Comparative-1 | Imidazole/epichlorohydrin | 175 | 151 | 4.1 | 5.2 | 61 |
| Comparative-2 | Imidazole/epichlorohydrin | 175 | 153 | 3.8 | 4.8 | 47 |

The higher the Rf value, the more reflective the surface. The lower the values of Ra and Rs are, the smoother the surface is. Lower values of Z indicate a more uniform surface height across the evaluated area. Thus, layers of copper having high reflectivity values and low Ra, Rs and Z-values are desired. As can be seen from the above data, the present leveling agents provide very smooth surfaces, that are as good as or better than, surface obtained from copper baths containing conventional leveling agents and suppressors.

EXAMPLE 19

The copper plating baths and plating conditions of Examples 17 and 18 are used to deposit a 1 μm thick copper layer on test wafers having a variety of features. After plating, the wafers are cross-sectioned and analyzed by scanning electron microscopy.

FIGS. 1 and 2 are SEMs showing layer of copper plated over 2 μm and 0.2 μm features, respectively, using the plating bath of Example 17. FIGS. 3 and 4 are SEMs showing a layer of copper plated over 2 μm and 0.2 μm features, respectively, using the plating bath of Example 18. These data clearly show that the present leveling agents provide level deposits over a wide variety of feature sizes with essentially no overplating.

What is claimed is:

1. A copper plating bath composition comprising a source of copper ions, an electrolyte and an additive compound, wherein the additive compound is a reaction product of a compound comprising one or more heteroatoms chosen from sulfur, nitrogen and a combination of sulfur and nitrogen, an alkylene oxide compound and a compound of formula (I)

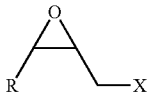

(I)

wherein X=halogen and R=H, $(C_1–C_{12})$alkyl or substituted $(C_1–C_{12})$alkyl.

2. The composition of claim 1 wherein the compound comprising one or more heteroatoms is an amine.

3. The composition of claim 2 wherein the amine is chosen from unsubstituted and substituted dialkylamines, unsubstituted and substituted trialkylamines, unsubstituted and substituted arylalkylamines, unsubstituted and substituted diarylamines, unsubstituted and substituted imidazole, unsubstituted and substituted triazole, unsubstituted and substituted tetrazole, unsubstituted and substituted benzimidazole, unsubstituted and substituted benzotriazole, unsubstituted and substituted piperidine, unsubstituted and substituted morpholine, unsubstituted and substituted piperazine, unsubstituted and substituted pyridine, unsubstituted and substituted oxazole, unsubstituted and substituted benzoxazole, unsubstituted and substituted pyrimidine, unsubstituted and substituted quinoline, unsubstituted and substituted isoquinoline, and mixtures thereof.

4. The composition of claim 1 wherein the compound of formula (I) is an epihalohydrin.

5. The composition of claim 1 wherein the alkylene oxide is chosen from glycols, polyalkylene glycols, monoalkyl alkyleneglycol ethers, monoalkyl polyalkylene glycol ethers, monoaryl alkyleneglycol ethers, monoaryl polyalkyleneglycol ethers, and mixtures thereof.

6. The composition of claim 1 wherein the additive compound is present in an amount of 0.5 to 10,000 ppm.

7. The composition of claim 1 wherein the additive compound is present in an amount of 1 to 5000 ppm.

8. The composition of claim 1 further comprising a brightener.

9. The composition of claim 1 wherein the electrolyte is an acid.

10. The composition of claim 1 wherein the source of copper ions is a soluble copper salt present in a concentration of 10 to 180 g/L as copper metal, wherein the electrolyte is an acid present in an amount of 5 to 250 g/L, wherein the additive compound is present in an amount of 1 to 5000 ppm, and wherein the composition further comprises 5 to 50 mg/L of one or more brighteners; and 15 to 75 ppm of a halide ion.

11. A method of depositing copper on a substrate comprising the steps of: contacting a substrate to be plated with copper with the copper plating bath of claim 1; and then applying a current density for a period of time sufficient to deposit a copper layer on the substrate.

12. A method of manufacturing an electronic device comprising the steps of: contacting an electronic device substrate with the copper plating bath of claim 1; and then applying a current density for a period of time sufficient to deposit a copper layer on the substrate.

13. The method of claim 12 wherein the substrate is an integrated circuit, a printed wiring board, or a lead frame.

* * * * *